US005784933A

United States Patent [19]

Persellin

[11] Patent Number: 5,784,933

[45] Date of Patent: Jul. 28, 1998

[54] APPARATUS FOR REMOVING A THREADED CAP FROM A CONTAINER

[76] Inventor: Avram Persellin, 3210 N. Cherry, Tucson, Ariz. 85719

[21] Appl. No.: 770,717

[22] Filed: Dec. 19, 1996

[51] Int. Cl.[6] ..... B67B 7/00

[52] U.S. Cl. ..... 81/3.36; 81/3.39

[58] Field of Search ..... 81/3.31, 3.32, 81/3.36, 3.39, 3.4

[56] References Cited

U.S. PATENT DOCUMENTS

| | | | |
|---|---|---|---|
| D. 277,160 | 1/1985 | Antone . | |
| D. 280,594 | 9/1985 | Dow . | |
| D. 320,916 | 10/1991 | Riddle et al. . | |
| D. 365,261 | 12/1995 | Munro . | |
| 1,324,586 | 12/1919 | Clasen | 81/3.32 |
| 1,615,196 | 1/1927 | Lilja . | |
| 1,887,152 | 11/1932 | Geisler . | |
| 1,913,906 | 6/1933 | Swenson . | |
| 1,954,422 | 4/1934 | McIntyre . | |
| 2,246,649 | 6/1941 | West . | |
| 2,589,693 | 3/1952 | Hess . | |
| 2,631,482 | 3/1953 | Rinehart . | |
| 2,761,337 | 9/1956 | Daniel | 81/3.4 |
| 3,604,290 | 9/1971 | Waite | 81/3.4 |
| 4,001,904 | 1/1977 | Gill . | |
| 4,337,678 | 7/1982 | Mumford . | |
| 4,702,129 | 10/1987 | Allen . | |
| 5,022,288 | 6/1991 | Taktakian . | |
| 5,517,881 | 5/1996 | Burns . | |

FOREIGN PATENT DOCUMENTS

| | | | |
|---|---|---|---|
| 2719440 | 11/1978 | Germany | 81/3.4 |
| 2 186 868 | 8/1987 | United Kingdom . | |

*Primary Examiner*—James G. Smith
*Assistant Examiner*—Benjamin M. Halpern
*Attorney, Agent, or Firm*—Snell & Wilmer

[57] ABSTRACT

An apparatus for removing a threaded cap from a container includes an upper body and a lower body configured to receive a threaded cap and a bottle, respectively, of a small container. The upper and lower bodies include integral coupling elements for coupling the bodies together when not in use. The upper body receives the cap in a conical aperture that is lined with a reinforcing insert and the lower body receives the bottle in an aperture that includes a number of steps having decreasing sizes to accommodate a variety of bottles. The apertures are configured such that the respective bodies can be compressed around the cap and bottle to facilitate removal of the cap from the bottle. The gripping strength and size of the apparatus enables the user to impart an increased amount of torque to the cap during removal.

19 Claims, 2 Drawing Sheets

APPARATUS FOR REMOVING A THREADED CAP FROM A CONTAINER

FIELD OF THE INVENTION

The present invention relates generally to devices for opening containers having threaded caps. More particularly, the present invention relates to a device that allows a user to impart enhanced torque to a container during removal of a threaded cap.

BACKGROUND OF THE INVENTION

Containers of liquids such as glues, paints, and manufacturing materials often become difficult to open when an amount of the contained liquid dries to form a seal around the cap or lid. The problem may be compounded when the container is relatively small in size (e.g., bottles of nail polish, typewriter correction fluid, and touch-up paint) due to the difficulty of gripping and manipulating a small bottle in a manner that effectively produces the torque required to "crack open" the threaded cap from the container. Conventional wrenches and other tools designed for rigorous tasks may damage the fragile bottles or caps often used in such applications. Accordingly, the prior art is replete with various devices designed to enable a person to quickly and easily remove a threaded cap or lid from its associated container. For example, a number of flexible rubber "wrenches," rigid tools formed from metal or plastic, and "grip enhancers" have been specifically developed to open food jars, beverage bottles, and other containers. Unfortunately, these conventional devices may be unduly cumbersome or otherwise undesirable for use in opening small containers such as nail polish bottles.

Many conventional bottle and jar opening devices lack the ability to effectively open a variety of differently-sized containers. For example, some prior art devices are rigidly configured to open a specific container, e.g., containers sealed with standard bottle caps. Other devices may be configured for compatibility with a small number of different container or cap sizes. Although such devices may exhibit increased usefulness over "single use" devices, they may be unable to readily adapt to variations in the shape or size of the containers.

One known device (disclosed in U.S. Pat. No. 4,702,129, issued Oct. 27, 1987 to Allen) receives a threaded cap within a cavity such that the user can apply an increased amount of torque by squeezing the device around the cap. However, removal of the cap from the cavity can be a difficult and frustrating chore, especially if the cap is coated with paint, glue, or other materials. Furthermore, the receiving cavity is not optimally designed to enable the user to impart an effective amount of compression about the cap without unnecessarily distorting the body of the device.

Gripping devices formed from soft rubber or urethane may provide increased user comfort at the expense of durability and performance. For example, a device formed from a very soft and resilient material, while perhaps comfortable to the hand, may not be capable of transferring adequate gripping forces to the cap. Furthermore, the material may tear or rip and the device may break free from the cap rather than effectively grip the cap during use. Consequently, the useful lifespan of such products may be dependent upon the type of materials selected.

Some conventional openers include a first element for gripping lids or caps and a second element for gripping bottles or containers. Two-piece devices are desirable to enable the user to impart an increased amount of torque simultaneously to the cap and container during use. However, such two-piece devices may be difficult to market, package, and display. In addition, two-piece devices may be bulky and cumbersome to use and inconvenient to maintain as a matched set for storage purposes.

SUMMARY OF THE INVENTION

Accordingly, the present invention provides an improved apparatus for removing a threaded cap from a container. In a preferred embodiment of the present invention, the apparatus is particularly suitable for use with small containers.

Another advantage is that the apparatus is configured for compatibility with an assortment of differently-sized containers and an assortment of differently-sized threaded caps.

A further advantage is that a threaded cap may be easily withdrawn from the subject apparatus after the cap has been removed from the container.

Another advantage is that the present invention provides an apparatus having an aperture configured to facilitate sufficient compression around the threaded cap without unnecessarily distorting the body of the apparatus.

A further advantage is that the apparatus is formed from a combination of materials to enhance user comfort and functional performance.

Another advantage is that the present invention provides an apparatus having two cooperating components that interlock for storage and display purposes when not in use.

The above and other advantages of the present invention are carried out in one form by an apparatus for removing a threaded cap from a container. The apparatus includes an upper body having an aperture shaped to receive a variety of differently-sized threaded caps, a lower body having an aperture shaped to receive a variety of differently-sized containers, and coupling elements for coupling the upper and lower bodies together. Either of the bodies may include a reinforcing insert located within its aperture.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF THE PREFERRED EMBODIMENT

Figure 1:
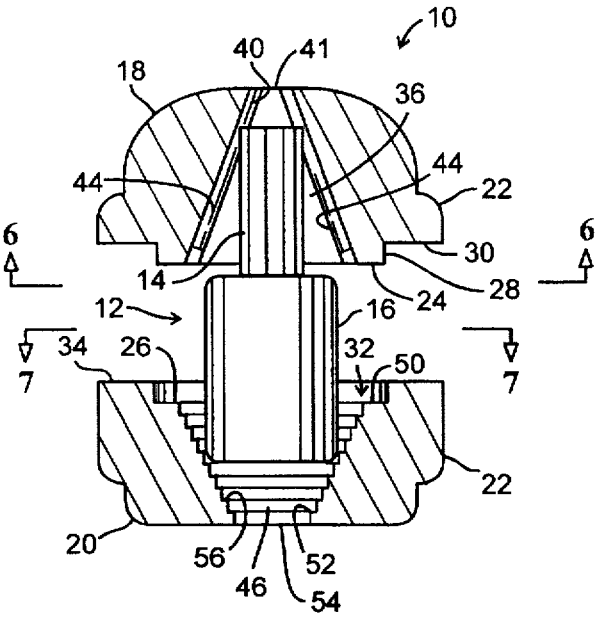
FIG. 1 is a cross sectional view of an apparatus according to the present invention along with an exemplary container upon which the apparatus may operate.
Figure 2:
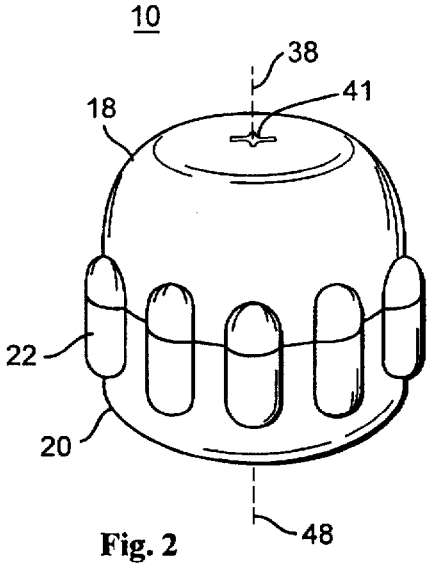
FIG. 2 is a perspective view of the apparatus in a coupled state suitable for storage or packaging.
Figure 3:
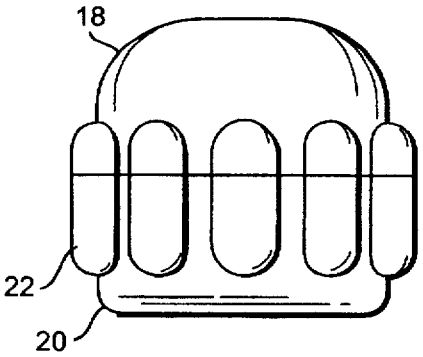
FIG. 3 is an elevation view of the apparatus shown in FIG. 2.

FIGS. 1–3 illustrate an apparatus 10 configured in accordance with a preferred embodiment of the present invention.

In FIG. 1, apparatus 10 is depicted in cross-section operating upon an exemplary nail polish container 12 having a threaded cap 14 and a bottle 16. It should be appreciated that the present invention may be alternatively configured to cooperate with any container having a twist-off lid or cap. Apparatus 10 is suitably configured to enable a user to impart an increased amount of torque to cap 14 or bottle 16 during removal or replacement of cap 14. Although this description focuses on the removal of cap 14, it should be appreciated that apparatus 10 may be similarly employed to replace cap 14 onto bottle 16. Although apparatus 10 preferably includes an upper body 18 and a cooperating lower body 20, those skilled in the art will recognize that the advantages of the present invention may be realized with independent use of either upper body 18 or lower body 20.

During removal of cap 14 from bottle 16, the user grasps upper body 18 and lower body 20, manually applies suitable external compressive forces to upper body 18 and lower body 20, and rotates upper body 18 relative to lower body 20. The external forces imparted by the user cause upper body 18 and lower body 20 to compress around cap 14 and bottle 16, respectively. The composition of apparatus 10 provides frictional gripping forces between upper body 18 and cap 14, and between lower body 20 and bottle 16, such that the torque applied by the user is imparted to cap 14 and bottle 16. A number of raised external ribs 22 formed on upper body 18 and lower body 20 are configured to enhance the user's grip and to facilitate rotation of upper body 18 and lower body 20.

Although the specific configuration of apparatus 10 may vary according to the specific application, upper body 18 and lower body 20 are preferably sized to comfortably fit within the hand of the user. This size is suitable for use with relatively small containers 12 such as nail polish bottles. In the preferred embodiment, upper body 18 and lower body 20 are each formed from a substantially solid, resilient, and pliable material such as rubber, elastomeric foam, or polyurethane. The material for upper body 18 and lower body 20 is selected such that apparatus 10 may be sufficiently compressed around container 12 during use while returning to its original undeformed shape after use. The material is also selected for ease of manufacturing and mechanical durability. In the preferred embodiment, upper body 18 and lower body 20 are each formed from a cured polyurethane foam that includes a 12–14 pound density polyether polyol resin mixed with a diisocianate prepolymer catalyst. Of course, upper body 18 or lower body 20 may be formed from any suitable compressible material as necessary for the particular application, and various physical properties, such as the modulus of elasticity, hardness, flexural strength, tensile strength, density, and the like, may vary.

Upper body 18 and lower body 20 may be formed from conventional molding processes such as injection molding. As a result of the molding process, upper body 18 and lower body 20 are substantially homogeneous components having relatively consistent material properties. It should be noted that other manufacturing techniques known to those skilled in the art may be implemented as necessary.

Upper body 18 and lower body 20 may be configured to couple together for a clean presentation and for convenient storage when not in use. FIGS. 2 and 3 depict apparatus 10 in such a coupled state. Although the present invention may utilize any suitable coupling configuration, apparatus 10 preferably employs a first coupling element 24 located on upper body 18 and a second coupling element 26 located on lower body 20 (see FIGS. 6–8). In accordance with a preferred aspect of the present invention, first coupling element 24 and second coupling element 26 are integrally formed within upper body 18 and lower body 20, respectively. Alternate embodiments of the present invention may incorporate distinct coupling elements such as snaps, clips, hook and loop fasteners, or the like.

Figure 7:
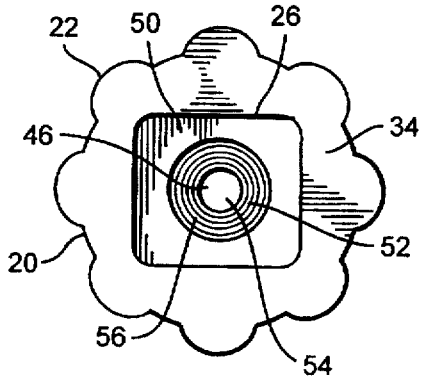
FIG. 7 is a plan view of the apparatus shown in FIG. 1, as viewed from line 7—7.
Figure 8:
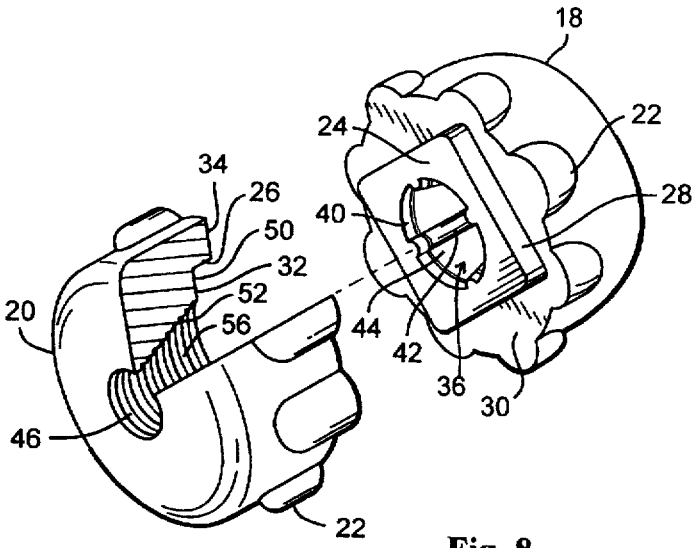
FIG. 8 is an exploded perspective view of the apparatus shown in FIG. 2.

As best shown in FIGS. 1 and 8, first coupling element 24 may include a column 28 that extends beyond a surface 30 of upper body 18. Column 28 preferably has a polygonal, e.g., a rectangular, cross section. Second coupling element 26 may include a corresponding cavity 32 configured to receive column 28. Column 28 may be sized and configured such that it engages and hence mates with cavity 32 via a manual press-fitting operation. Lower body 20 includes a surface 34 (see FIGS. 7 and 8) that mates with surface 30 of upper body 18 when upper and lower bodies 18 and 20 are coupled together. The resiliency of the material (e.g., polyurethane) that forms upper and lower bodies 18 and 20 enables first and second coupling elements 24 and 26 to snugly mate together. To ensure an adequate press-fit, the perimeter of column 28 may be slightly larger than the corresponding perimeter of cavity 32. The interconnectivity of upper and lower bodies 18 and 20 enables apparatus 10 to be conveniently displayed and stored as a single unit.

The polygonal shape of column 28 and cavity 32 is desirable to ensure that upper body 18 is restricted to a specific number of orientations, relative to lower body 20, when upper and lower bodies 18 and 20 are coupled together. In other words, the shape of column 28 and cavity 32 functions as an orienting key to facilitate consistent alignment of upper and lower bodies 18 and 20 during packaging, display, and storage.

Figure 4:
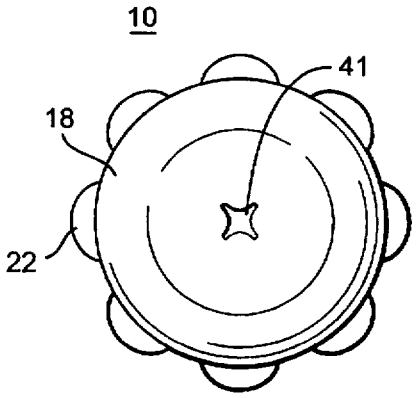
FIG. 4 is a top plan view of the apparatus shown in FIG. 2.
Figure 6:
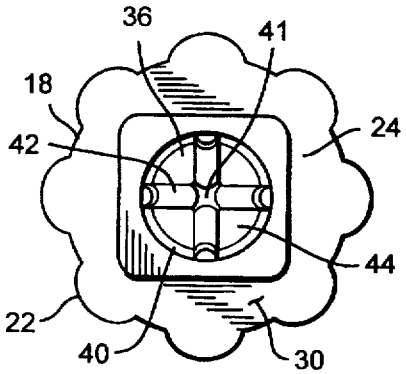
FIG. 6 is a plan view of the apparatus shown in FIG. 1, as viewed from line 6—6.

Referring to FIGS. 1, 4, and 6, upper body 18 will be described in more detail. In the illustrated embodiment, upper body 18 suitably includes an aperture 36 formed therein generally along its longitudinal axis 38 (indicated in FIG. 2). As best shown in FIG. 1, aperture 36 may extend through, and coterminate with, column 28. Aperture 36 preferably extends through upper body 18 along longitudinal axis 38 to facilitate compression of upper body 18 in a direction normal to longitudinal axis 38 during use. Upper body 18 may become compressed in response to an external force applied to apparatus 10 by the user. Aperture 36 is suitably shaped to receive a variety of differently-sized threaded caps 14; in the preferred embodiment, aperture 36 is generally conical in shape. Thus, in operation, threaded cap 14 is inserted into aperture 36 such that it snugly contacts the interior surface 40 of aperture 36 at an appropriate depth (as depicted in FIG. 1).

Upper body 18 preferably includes a hole 41 that communicates with aperture 36 such that aperture 36 forms a core through the center of upper body 18. Hole 41 is suitably configured to facilitate substantially uniform compression of upper body 18 around threaded cap 14 without excessively distorting upper body 18. Furthermore, hole 41 is desirably sized to provide access to threaded cap 14 during use to, for example, enable the user to easily remove threaded cap 14 from upper body 18 after removal.

Upper body 18 may include a plurality of integral ribs 42 formed within aperture 36 such that they protrude beyond interior surface 40. Ribs 42 are suitably arranged to provide additional gripping strength and structural integrity to upper body 18. Although the preferred embodiment utilizes four ribs 42 arranged in a symmetrical pattern around aperture 36, the precise number and configuration of ribs 42 may vary depending upon the specific application.

According to a preferred aspect of the present invention, upper body 18 includes an insert 44 that preferably lines a portion of aperture 36 and a portion of each of ribs 42 to thereby reinforce body 18 proximate aperture 36. In the preferred embodiment, insert 44 is formed from a different material than upper and lower bodies 18 and 20, e.g., latex rubber. Insert 44 may be integrally molded into upper body 18 or affixed to upper body 18 via any number of conventional techniques.

The specific composition of insert 44 may be selected to increase the gripping strength and durability of apparatus 10. For example, it may be desirable to utilize a latex rubber composition that exhibits less resiliency than the polyurethane material that forms upper body 18. Alternatively, insert 44 may be formed from a stronger plastic or nylon material if required by the particular application.

Figure 5:
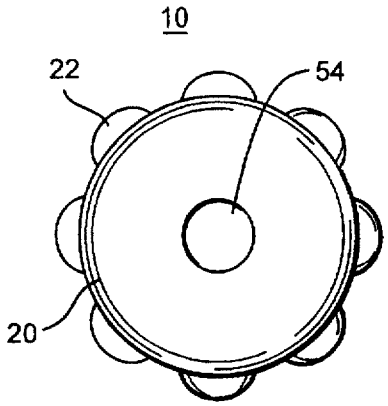
FIG. 5 is a bottom plan view of the apparatus shown in FIG. 2.

Referring to FIGS. 1, 5, and 7, lower body 20 will be described in more detail. As discussed above in connection with upper body 18, lower body 20 also suitably includes an aperture 46 formed therein generally along its longitudinal axis 48 (indicated in FIG. 2). Due to the symmetry of apparatus 10, longitudinal axis 38 and longitudinal axis 48 are approximately collinear when upper and lower bodies 18 and 20 are coupled together. As best shown in FIG. 1, aperture 46 preferably terminates at an inner surface 50 of cavity 32. Aperture 46 preferably extends through lower body 20 along longitudinal axis 48 to facilitate compression of lower body 20 in a direction normal to longitudinal axis 48 during use. Aperture 46 is suitably shaped to receive a variety of differently-sized bottles 16. In operation, bottle 16 is inserted into aperture 46 such that it snugly contacts the interior surface 52 of aperture 46 at an appropriate depth (as depicted in FIG. 1).

Lower body 20 may include a hole 54 that communicates with aperture 46 such that aperture 46 forms a core through the center of lower body 20. Hole 54 is suitably configured to facilitate substantially even compression of lower body 20 around bottle 16 without excessively distorting lower body 20. Furthermore, hole 54 is desirably sized to provide access to bottle 16 during use. As with hole 41, hole 54 is configured to facilitate easy removal of bottle 16 from lower body 20 after removal of threaded cap 14 from bottle 16.

The preferred embodiment contemplates use with substantially round (i.e., circular cross-section) bottles 16. Accordingly, aperture 46 preferably includes a plurality of circumferential steps 56 formed within lower body 20. Circumferential steps 56 provide a number of ridges upon which bottle 16 may rest after insertion into aperture 46. Circumferential steps 56 progress in a decreasing manner such that a generally conical shape is defined within aperture 46. It should be noted that the present invention is not limited to any specific number or configuration of circumferential steps 56, or to a circular cross-section. Furthermore, aperture 46 may be alternatively shaped to accommodate any number of different containers 12 or bottles 16 having various shapes and configurations. Indeed, nothing prevents apparatus 10 from employing substantially similar upper and lower bodies 18 and 20.

Although not shown, lower body 20 may employ an insert as described above in connection with upper body 18. Those skilled in the art will recognize that lower body 20 may be suitably reinforced in the same manner as upper body 18 to increase the gripping strength and/or the durability of apparatus 10.

In summary, a preferred embodiment of the present invention provides an improved apparatus for removing a threaded cap from a container. The apparatus is particularly suitable for use with small containers and is configured for compatibility with an assortment of differently-sized containers and bottles and caps. The apparatus is configured to enable a cap to be easily withdrawn from the apparatus after the cap has been removed from the container. The apparatus includes an aperture that facilitates compression around the threaded cap or container without unnecessarily distorting the body of the apparatus. The apparatus is formed from a combination of materials to enhance user comfort and functional performance. Furthermore, the apparatus preferably has two cooperating components that couple together for storage and display purposes when not in use.

The present invention has been described above with reference to a preferred embodiment. However, those skilled in the art will recognize that changes and modifications may be made to the preferred embodiment without departing from the scope of the present invention. These and other changes or modifications are intended to be included within the scope of the present invention, as expressed in the following claims.

What is claimed is:

1. An apparatus for unscrewing a threaded cap from its associated threaded container, said apparatus comprising:

a first body having a first aperture formed therein, said first aperture being shaped to receive a variety of differently-sized threaded caps;

a second body having a second aperture formed therein, said second aperture being shaped to receive a variety of differently-sized containers; and means for coupling said first body to said second body, wherein said means for coupling comprises a first coupling element located on said first body and a second coupling element located on said second body, and wherein said first coupling element is configured to mate with said second coupling element via a press-fitting engagement.

2. An apparatus according to claim 1, wherein said first and second coupling elements are integrally formed within said first and second bodies, respectively.

3. An apparatus according to claim 1, wherein said first and second bodies are formed from a substantially resilient and pliable material.

4. An apparatus according to claim 1, wherein said first body further comprises a hole formed therein, said hole communicating with said first aperture and configured to provide access to said threaded cap during use.

5. An apparatus according to claim 1, wherein said second body further comprises a second hole formed therein, said second hole communicating with said second aperture and configured to provide access to said container during use.

6. An apparatus for unscrewing a threaded cap from its associated threaded container, said apparatus comprising:

a first body having a first aperture formed therein, said first aperture being shaped to receive a variety of differently-sized threaded caps;

a second body having a second aperture formed therein, said second aperture being shaped to receive a variety of differently-sized containers; and means for coupling said first body to said second body, wherein:

said means for coupling comprises a first coupling element located on said first body and a second coupling element located on said second body;

said first body includes a first surface and said second body includes a second surface that mates with said first surface when said upper and lower bodies are coupled together;

said first coupling element comprises a column extending beyond said first surface; and said first aperture extends through said column.

7. An apparatus according to claim 6, wherein said first coupling element and said second coupling element are integrally formed within said first and second bodies, respectively.

8. An apparatus according to claim 6, wherein said means for coupling is configured such that said first body is restricted to a specific number of orientations, relative to said second body, when said first and second bodies, are coupled together.

9. An apparatus according to claim 6, wherein said first body further comprises a first hole formed therein, said first hole communicating with said first aperture and configured to provide access to said threaded cap during use.

10. An apparatus according to claim 6, wherein said second body further comprises a second hole formed therein, said second hole communicating with said second aperture and configured to provide access to said container during use.

11. An apparatus for removing a threaded cap from a container, said apparatus comprising:

a substantially solid body formed from a first material and having an aperture formed therein, said aperture being shaped to receive one of said threaded cap and said container; and an insert formed from a second material that is less resilient than said first material, said insert lining at least a portion of said aperture to thereby reinforce said body proximate said aperture.

12. An apparatus according to claim 11, wherein said first material comprises polyurethane and said second material comprises rubber.

13. An apparatus according to claim 11, wherein:

said body has a longitudinal axis; and said aperture extends through said body along said longitudinal axis to facilitate compression of said body in a direction normal to said longitudinal axis during use.

14. An apparatus according to claim 11, wherein said aperture has an interior surface and said apparatus further comprises a plurality of ribs integrally formed within said body and protruding beyond said interior surface.

15. An apparatus according to claim 11, wherein said body further comprises a hole formed therein, said hole communicating with said aperture and configured to provide access to said threaded cap during use.

16. An apparatus according to claim 14, wherein said insert covers at least a portion of each of said ribs.

17. An apparatus according to claim 11, wherein said aperture is substantially conical.

18. An apparatus according to claim 16, wherein said aperture includes a plurality of circumferential steps formed within said first body.

19. An apparatus according to claim 11, wherein said aperture is configured to facilitate compression of said body around said threaded cap in response to an external force applied to said body.

* * * * *